United States Patent [19]

Gannaway

[11] Patent Number: 4,834,627

[45] Date of Patent: May 30, 1989

[54] COMPRESSOR LUBRICATION SYSTEM INCLUDING SHAFT SEALS

[75] Inventor: Edwin L. Gannaway, Adrian, Mich.

[73] Assignee: Tecumseh Products Co., Tecumseh, Mich.

[21] Appl. No.: 148,058

[22] Filed: Jan. 25, 1988

[51] Int. Cl.[4] ..... F04B 35/04; F04B 39/10

[52] U.S. Cl. ..... 417/415; 417/534; 417/902; 184/6.16

[58] Field of Search ..... 417/366, 372, 902, 415, 417/534, 529; 184/6.6, 6.16, 6.18; 277/12, 14 V, 27, 215, DIG. 8; 418/94, 102

[56] References Cited

U.S. PATENT DOCUMENTS

| | | | |
|---|---|---|---|
| 1,497,009 | 6/1924 | Bull | 184/6.5 |
| 2,199,699 | 5/1940 | Frelin | 184/6.5 |
| 2,489,527 | 11/1949 | Frank | 184/6.5 |
| 2,752,088 | 6/1956 | Borgerd et al. | 417/902 X |
| 3,154,244 | 10/1964 | Touborg | 417/372 |
| 3,248,044 | 9/1964 | Parker | 417/372 |
| 3,279,683 | 10/1966 | Kleinlein | 417/902 X |
| 3,451,615 | 6/1969 | Hover | 417/372 |
| 3,498,530 | 3/1970 | Hover | 417/415 |
| 3,836,216 | 9/1974 | Junker | 277/27 X |
| 3,842,938 | 10/1974 | Moss | 184/6.5 |
| 4,103,903 | 8/1978 | Capriotti et al. | 277/27 |
| 4,345,797 | 8/1982 | Ballheimer | 308/122 |
| 4,470,772 | 9/1984 | Gannaway | 417/368 |
| 4,478,559 | 10/1984 | Andrione et al. | 417/368 |
| 4,497,494 | 2/1985 | Allen et al. | 277/27 |
| 4,518,323 | 5/1985 | Elson et al. | 417/372 X |
| 4,547,131 | 10/1985 | Riffe et al. | 417/53 |

*Primary Examiner*—Carlton R. Croyle
*Assistant Examiner*—Leonard P. Walnoha
*Attorney, Agent, or Firm*—Albert L. Jeffers; John F. Hoffman; David L. Ahlersmeyer

[57] ABSTRACT

A direct suction hermetic compressor assembly is disclosed including a hermetically sealed housing having enclosed therein a compressor mechanism discharging compressed gas refrigerant into the interior of the housing, thereby creating a high pressure housing. The compressor mechanism includes a crankcase defining a suction cavity into which low pressure suction gas is directly introduced. Bearings in the crankcase communicate between the housing interior and the suction cavity, and rotatably support a crankshaft. Annular seals received within grooves in the crankshaft bear against the bearings and are actuated and lubricated by oil fed from within the grooves to prevent high to low pressure gas leakage and to facilitate bearing lubrication. A scotch yoke mechanism operably couples a plurality of radially disposed pistons to a crankshaft eccentric portion within the suction cavity. Oil ducts open onto the loaded surface of the eccentric to limit oil leakage into the suction cavity.

29 Claims, 3 Drawing Sheets

COMPRESSOR LUBRICATION SYSTEM INCLUDING SHAFT SEALS

BACKGROUND OF THE INVENTION

The present invention relates generally to a hermetic compressor assembly and, more particularly, to such a compressor assembly having high and low pressure regions within a sealed housing, wherein it is desired to minimize gas and oil leakage from the high pressure regions into the low pressure regions to improve compressor efficiency.

In general, prior art hermetic compressor assemblies comprise a housing which is hermetically sealed and within which is located a compressor mechanism including a crankcase. The present invention can be applied to a reciprocating piston compressor having a scotch yoke control mechanism. In such a compressor, the crankcase defines a plurality of radially disposed cylinders and a central suction cavity into which the cylinders open. A crankshaft is rotatably journalled in axially aligned bearing in the crankcase and includes an eccentric portion located in the suction cavity. Pistons reciprocable in the cylinders are operably coupled to the eccentric portion by means of a scotch yoke mechanism. The scotch yoke mechanism typically includes a slide block defining a coupling bearing in which the eccentric portion is journalled. Suction gas from the refrigeration system is provided directly to the suction cavity and is introduced within the cylinders by means of suction valves associated with the pistons. The gas refrigerant is then compressed within the cylinder and discharged into the interior of the housing to provide a pressurized, or high side, sealed housing.

In the aforementioned compressor assembly, a pressure differential is created between the high pressure region defined by the housing and the low pressure region defined by the suction cavity within the crankcase. In a typical compressor, a pressure differential between high and low pressure regions may be on the order of a 4 to 1 ratio. As a result of this pressure differential, several problems arise relating to leakage of gas and oil from high pressure regions to low pressure regions. The primary disadvantage of gas leakage from the high side housing to the suction cavity is that compressor operating efficiency is reduced as the refrigeration system is bypassed and no useful work is performed. Leakage of excessive amounts of oil into the suction cavity may result in damage to suction valves in the piston valve assembly.

A primary source of gas leakage from the high pressure housing into the low pressure suction cavity is the leakage occurring past the crankshaft where it is journalled in bearings in the crankcase. The cylindrical sleeve bearings supporting the crankshaft are exposed to high pressure and low pressure at opposite ends thereof. Consequently, gas leakage occurs which reduces compressor operating efficiency. Also, high flow leakage through the bearings makes it difficult to lubricate the bearings properly. Specifically, oil introduced at a single location along the circumference of the crankshaft or the bearing is blown into the crankcase suction cavity before it is evenly distributed for effective lubrication. Accordingly, dry spots are created along the shaft bearing surface, which do not receive proper lubrication and, therefore, do not experience a long operating life.

A primary source of oil leakage into the suction cavity is the oil introduced at the surface of the eccentric portion of the crankshaft to lubricate the eccentric as it is journalled within a bearing in the scotch yoke slide block. As is the practice in virtually all crankshaft connecting rod assemblies, oil ducts leading to the surface of the eccentric portion are located on the unloaded journalled portion. Accordingly, a slight clearance is created to allow oil to flow so as to provide adequate lubrication. However, in the case of the aforementioned compressor assembly having a pressurized housing, the oil delivered to the eccentric portion in the suction cavity is essentially at the higher discharge pressure. As a result, excessive amounts of oil and gas are introduced within the suction cavity, thereby resulting in a loss of compressor operating efficiency. Furthermore, damage may occur to the crankshaft bearings, particularly the upper bearing, if the oil supply from the lubrication system is diminished or depleted due to excessive oil leakage at the location of the eccentric portion.

The problems associated with a scotch yoke compressor, as described herein, have not been addressed by the prior art, as evidenced by the fact that high side scotch yoke compressors are not generally commercially available. In a low side housing design, either a pressure differential between the suction cavity and housing interior does not exist, or it is of much lesser magnitude. In such a design, oil used for lubricating the crankshaft bearings is prevented from freely entering the suction cavity by means of a thrust bearing between the end of the bearing and the counterweight on the shaft. This prevents excessive amounts of oil at a nominal oil pump pressure from entering the suction cavity.

With respect to prior art attempts to limit the amount of oil entering the suction cavity from the crankshaft eccentric and slide block assembly, the idea of locating the oil opening on the unloaded side of the eccentric is so engrained in the prior art teachings that very few alternative methods have been proposed. More importantly, the problem has not been as severe in the case of compressor assemblies wherein a high pressure differential between the housing and the suction cavity does not exist. Although a smaller oil delivery hole in the eccentric portion would limit oil flow, smaller holes will result in drill bit breakage which would certainly present a problem in a mass production manufacturing environment. Another alternative to limit the flow of oil into the suction cavity is to alter the oil pump of the lubrication system to produce a smaller head of oil available at the eccentric portion.

While it is necessary for the proper operation of a compressor assembly of the type herein described to permit some small amount of oil to leak into the suction cavity, the prior art has not adequately addressed the problem of limiting leakage of excessive gas and oil into the suction cavity of a high side compressor. More specifically, leakage of gas and oil from regions of high pressure to regions of low pressure for a compressor mechanism within a pressurized housing have not been adequately addressed by the prior art. Also, proper lubrication of crankshaft bearings in such compressors remains a problem.

SUMMARY OF THE INVENTION

The present invention addresses the problems presented by a high side compressor assembly, such as a scotch yoke compressor, and any disadvantages associated with the approaches undertaken in prior art devices relating to low pressure housing compressor assemblies. Generally, the present invention provides a compressor assembly wherein a rotatable crankshaft is journalled in a bearing exposed to low pressure at one end thereof and to high pressure at the other end thereof, whereby a pressure differential exists. Further provided in the compressor assembly of the present invention is a coupling mechanism to operably couple reciprocating pistons to a crankshaft eccentric portion, wherein the eccentric and coupling mechanism is located in a low pressure region while oil for lubricating the coupling mechanism is delivered at high pressure. In accord with the present invention, seal means are provided between the rotating shaft and the bearing to prevent leakage through the bearing from the high pressure region to the low pressure region. Furthermore, the present invention provides means for limiting the amount of high pressure oil used for lubricating the crankshaft eccentric that enters the low pressure region.

More specifically, the invention provides, in one form thereof, a reciprocating piston compressor assembly, such as a scotch yoke compressor, wherein high pressure gas is discharged into the hermetically sealed housing. A crankcase mounted within the housing includes a suction cavity enclosed therein at a low pressure. High pressure discharge gas in the housing is prevented from entering the suction cavity through crankshaft bearings in the crankcase by means of annular seals disposed between the crankshaft and the bearing. Leakage into the suction cavity of high pressure oil used to lubricate the scotch yoke mechanism is controlled by locating the oil delivery holes to the loaded side of the crankshaft eccentric portion.

One advantage of the shaft seals of the present invention is greatly reduced leakage of high pressured gas and oil into the suction cavity. As a consequence of this reduced leakage, compressor operating efficiency is increased.

Another advantage of the shaft seals of the present invention is improved lubrication of the bearings in which the crankshaft is journalled.

A still further advantage of the shaft seals of the present invention wherein the seals are made of Teflon, is reduced wear of the seals and reduced friction between the Teflon seal and steel crankshaft and crankcase components.

Yet another advantage of the shaft seals of the present invention is that an initial seal between the crankshaft and bearing is provided without oil actuation, due to the use of an oversized annular seal.

Yet another advantage of the eccentric lubrication system of the present invention is reduced entry of lubricating oil into the suction cavity, thereby helping to maintain an adequate supply of lubricating oil to the crankshaft bearings, particularly the upper bearing.

A still further advantage of the eccentric lubrication system of the present invention is improved control of oil leakage into the suction cavity while maintaining ease of manufacture of the compressor crankshaft.

Another advantage of the present invention is that the component parts of the shaft seals and eccentric lubrication system are easily assembled in the compressor assembly.

The compressor assembly of the present invention, in one form thereof, provides a hermetically sealed housing having a discharge pressure space therein. A crankcase within the housing includes a pair of axially aligned sleeve bearings and a plurality of cylinders. The crankcase includes a suction cavity into which the bearings and cylinder open. Each bearing has a first end communicating with the discharge pressure space and a second end communicating with the suction cavity. A crankshaft is rotatably journalled in the sleeve bearings and has an eccentric portion located in the suction cavity when the compressor is assembled. A plurality of pistons are operably coupled to the eccentric portion and are disposed in respective cylinders. The pistons compress and discharge gaseous refrigerant into the discharge pressure space. Furthermore, seal means are provided for separating the suction cavity from the discharge pressure space such that, during the compressor operation, pressure leakage from the discharge pressure space into the suction cavity through the pair of bearings is substantially eliminated. The seal means comprises a pair of annular sealing elements disposed between the crankshaft and a respective bearing. Additionally the compressor assembly according to this form of the invention may provide means for supplying lubricating oil from an oil sump in the housing to the pair of bearings journalling the crankshaft.

There is provided, in one form of the present invention, a compressor assembly comprising a hermetically sealed housing including a discharge pressure space, and a crankcase within the housing. The crankcase includes a pair of axially aligned sleeve bearings and a plurality of cylinders formed therein. The crankcase also includes a suction cavity into which the bearings and the cylinders open. Each of the pair of bearings has a first end communicating with the discharge pressure space and a second end communicating with the suction cavity. Also provided is a crankshaft having a pair of journals and an eccentric portion located in the suction cavity. Each journal has an annular groove formed therein and is rotatably supported in a respective bearing. Operably coupled to the eccentric portion is a plurality of pistons disposed in respective cylinders for compressing and discharging refrigerant into the discharge pressure space. The compressor assembly further comprises a pair of ring-like sealing elements, each having an inside diameter portion positioned in a respective annular groove and an outside diameter portion contacting a corresponding bearing. Means for supplying lubricating oil from a sump in the housing to the annular grooves is provided such that oil lubricates the sealing elements and the bearings. The oil supplying means includes an axial oil passageway extending through the crankshaft.

The compressor assembly of the present invention further provides, in one form thereof, a housing, a crankcase within the housing having a plurality of cylinders, and a crankshaft rotatably journalled in the crankcase having a central axis of rotation and including a cylindrical eccentric portion with respect to the central axis. Operably received within the cylinders is a plurality of pistons. Coupling means are provided for operably coupling the pistons to the eccentric portion, the coupling means including a sleeve bearing in which the eccentric portion is journalled. Means are also provided for lubricating the sleeve bearing. The lubricating means includes an oil delivery hole in the eccentric portion located on a radially outermost semicylindrical surface of the eccentric portion with respect to the central axis.

The invention further provides, in one form thereof, for an improved scotch yoke compressor assembly including a housing and a crankcase within the housing having a suction cavity therein. A plurality of cylinders extend radially outwardly from the suction cavity. A plurality of pistons are operably received within respective cylinders. Also provided is a crankshaft rotatably journalled in the crankcase and having an axis of rotation and an eccentric portion.located within the suction cavity. Means are provided for operably coupling the plurality of pistons to the eccentric portion, including a bearing surface against which the eccentric portion rides to cause reciprocation of the pistons. Also included in the scotch yoke compressor assembly is means for providing lubricating oil from a sump in the housing to an axial oil passageway in the crankshaft extending to the eccentric portion. The pressure of the oil in the crankshaft is substantially greater than the pressure present in the suction cavity. The improvement to the described compressor assembly, according to the present invention, comprises means for lubricating the bearing surface such that lubricating oil introduced into the suction cavity is substantially reduced to improve the operating efficiency of the compressor. The lubricating means comprises a pair of radial oil ducts providing communication between the oil passageway and a pair of openings on a surface of the eccentric portion located on the radially outermost semicylindrical surface of the eccentric portion with respect to the axis of rotation. The pair of openings are substantially symmetric with respect to a line on the outermost semicylindrical surface parallel to the axis of rotation and representing maximum eccentricity.

The present invention still further provides, in one form thereof, a compressor assembly having a hermetically sealed housing including a discharge pressure space. A crankcase is provided within the housing including a pair of axially aligned sleeve bearings and a plurality of radially disposed cylinders formed therein. The crankcase includes a suction cavity into which the pair of bearings and the plurality of cylinders open. Each bearing has a first end in communication with the discharge pressure space and a second end in communication with the suction cavity. The invention further provides a crankshaft rotatably journalled in the crankcase and having a central axis of rotation. The crankshaft also includes a cylindrical eccentric portion with respect to the central axis. Seal means are provided for separating the suction cavity from the discharge pressure space such that, during compressor operation, pressure leakage from the discharge pressure space into the suction cavity through the pair of bearings is substantially eliminated. The seal means comprises a pair of annular sealing elements each disposed between the crankshaft and the respective bearing. A plurality of pistons is operably received within the respective cylinders for compressing and discharging gas refrigerant into the discharge pressure space. Coupling means including a coupling bearing in which the eccentric portion is journalled are provided, and operably couple the plurality of pistons to the eccentric portion. Means are provided for lubricating the coupling bearing surface such that the amount of lubricating oil introduced into the suction cavity is substantially reduced to improve operating efficiency of the compressor. The lubricating means includes an oil delivery hole in the eccentric portion located on the radially outermost semicylindrical surface of the eccentric portion with respect to the central axis.

DESCRIPTION OF THE PREFERRED EMBODIMENT

Figure 1:
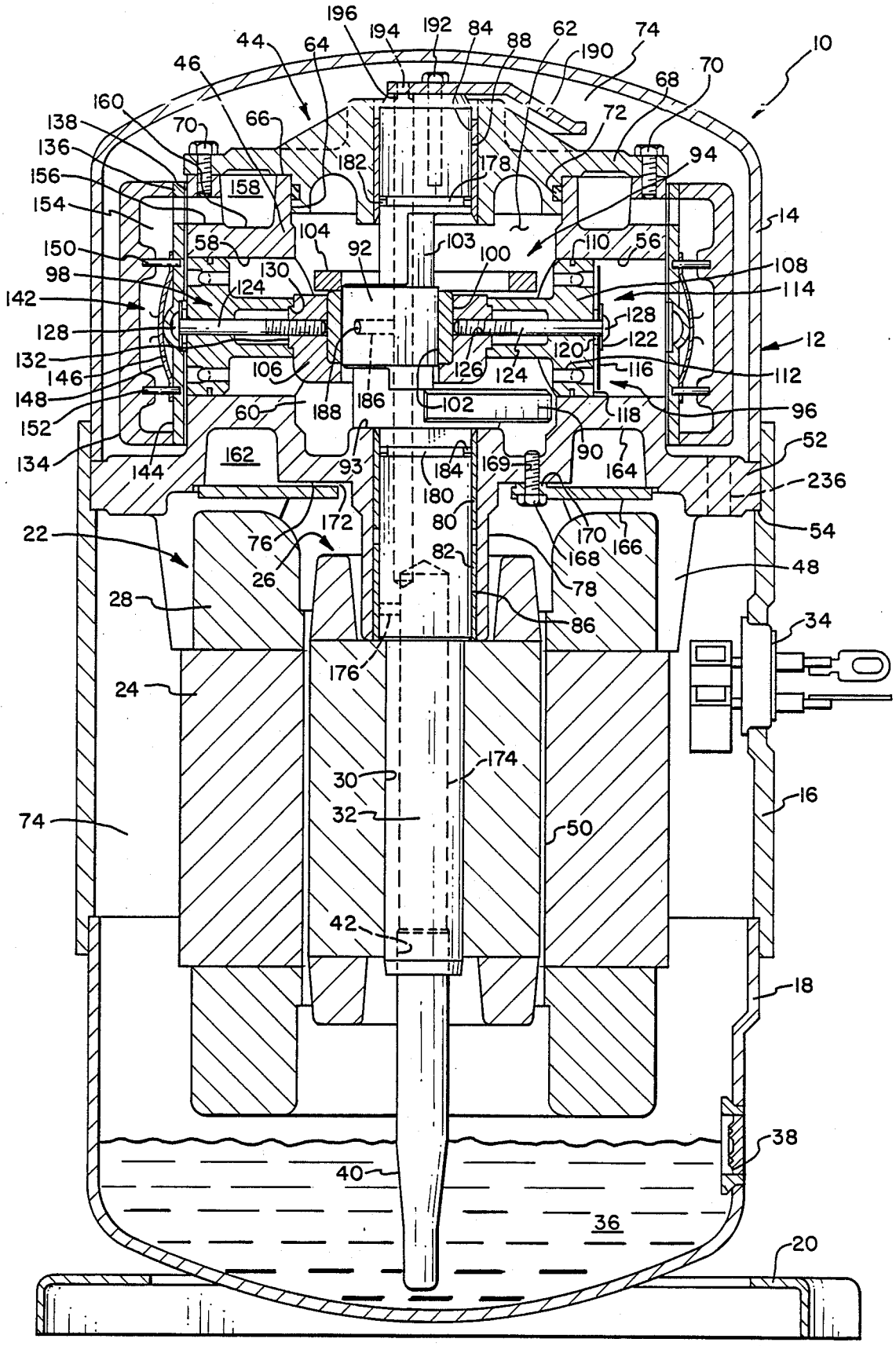
FIG. 1 is a side sectional view of a compressor of the type to which the present invention pertains.

In an exemplary embodiment of the invention as shown in the drawings, and in particular by referring to FIG. 1, a compressor assembly 10 is shown having a housing generally designated at 12. The housing has a top portion 14, a central portion 16, and a bottom portion 18. The three housing portions are hermetically secured together as by welding or brazing. A mounting flange 20 is welded to the bottom portion 18 for mounting the compressor in a vertically upright position. Located within hermetically sealed housing 12 is an electric motor generally designated at 22 having a stator 24 and a rotor 26. The stator is provided with windings 28. Rotor 26 has a central aperture 30 provided therein into which is secured a crankshaft 32 by an interference fit. A terminal cluster 34 is provided in central portion 16 of housing 12 for connecting the compressor to a source of electric power. Where electric motor 22 is a three-phase motor, bidirectional operation of compressor assembly 10 is achieved by changing the connection of power at terminal cluster 34.

Compressor assembly 10 also includes an oil sump 36 located in bottom portion 18. An oil sight glass 38 is provided in the sidewall of bottom portion 18 to permit viewing of the oil level in sump 36. A centrifugal oil pick-up tube 40 is press fit into a counterbore 42 in the end of crankshaft 32. Oil pick-up tube 40 is of conventional construction and includes a vertical paddle (not shown) enclosed therein.

Also enclosed within housing 12, in the embodiment of FIG. 1, is a compressor mechanism generally designated at 44. Compressor mechanism 44 comprises a crankcase 46 including a plurality of mounting lugs 48 to which motor stator 24 is attached such that there is an annular air gap 50 between stator 24 and rotor 26. Crankcase 46 also includes a circumferential mounting flange 52 axially supported within an annular ledge 54 in central portion 16 of the housing. A bore 236 extends through flange 52 to provide communication between the top and bottom ends of housing 12 for return of lubricating oil and equalization of discharge pressure within the entire housing interior.

Compressor mechanism 44, as illustrated in the preferred embodiment, takes the form of a reciprocating piston, scotch yoke compressor. More specifically, crankcase 46 includes four radially disposed cylinders, two of which are shown in FIG. 1 and designated as cylinder 56 and cylinder 58. The four radially disposed cylinders open into and communicate with a central suction cavity 60 defined by inside cylindrical wall 62 in crankcase 46. A relatively large pilot hole 64 is provided in a top surface 66 of crankcase 46. Various compressor components, including the crankshaft, are assembled through pilot hole 64. A top cover such as cage bearing 68 is mounted to the top surface of crankcase 46 by means of a plurality of bolts 70 extending through bearing 68 into top surface 66. When bearing 68 is assembled to crankcase 46, an O-ring seal 72 isolates suction cavity 60 from a discharge pressure space 74 defined by the interior of housing 12.

Crankcase 46 further includes a bottom surface 76 and a bearing portion 78 extending therefrom. Retained within bearing portion 78, as by press fitting, is a sleeve bearing assembly comprising a pair of sleeve bearings 80 and 82. Two sleeve bearings are preferred rather than a single longer sleeve bearing to facilitate easy assembly into bearing portion 78. Likewise, a sleeve bearing 84 is provided in cage bearing 68, whereby sleeve bearings 80, 82, and 84 are in axial alignment. Sleeve bearings 80, 82, and 84 are manufactured from steel-backed bronze.

A sleeve bearing, as referred to herein, is defined as a generally cylindrical bearing surrounding and providing radial support to a cylindrical portion of a crankshaft, as opposed to a thrust bearing which provides axial support for the weight of the crankshaft and associated parts. A sleeve bearing, for example, may comprise a steel-backed bronze sleeve insertable into a crankcase, or a machined cylindrical surface made directly in the crankcase casting or another frame member.

Referring once again to crankshaft 32, there is provided thereon journal portions 86 and 88, wherein journal portion 86 is received within sleeve bearings 80 and 82, and journal portion 88 is received within sleeve bearing 84. Accordingly, crankshaft 32 is rotatably journalled in crankcase 46 and extends through a suction cavity 60. Crankshaft 32 includes a counterweight portion 90 and an eccentric portion 92 located opposite one another with respect to the central axis of rotation of crankshaft 32 to thereby counterbalance one another. The weight of crankshaft 32 and rotor 26 is supported on thrust surface 93 of crankcase 46.

Eccentric portion 92 is operably coupled by means of a scotch yoke mechanism 94 to a plurality of reciprocating piston assemblies corresponding to, and operably disposed within, the four radially disposed cylinders in crankcase 46. As illustrated in FIG. 1, piston assemblies 96 and 98, representative of four radially disposed piston assemblies operable in compressor assembly 10, are associated with cylinders 56 and 58, respectively.

Scotch yoke mechanism 94 comprises a slide block 100 including a cylindrical bore 102 in which eccentric portion 92 is journalled. In the preferred embodiment, cylindrical bore 102 is defined by a steel backed bronze sleeve bearing press fit within slide block 100. A reduced diameter portion 103 in crankshaft 32 permits easy assembly of slide block 100 onto eccentric portion 92. Scotch yoke mechanism 94 also includes a pair of yoke members 104 and 106 which cooperate with slide block 100 to convert orbiting motion of eccentric portion 92 to reciprocating movement of the four radially disposed piston assemblies. For instance, FIG. 1 shows yoke member 106 coupled to piston assemblies 96 and 98, whereby when piston assembly 96 is at a bottom dead center (BDC) position, piston assembly 98 will be at a top dead center (TDC) position.

Referring once again to piston assemblies 96 and 98, each piston assembly comprises a piston member 108 having an annular piston ring 110 to allow piston member 108 to reciprocate within a cylinder to compress gaseous refrigerant therein. Suction ports 112 extending through piston member 108 allow suction gas within suction cavity 60 to enter cylinder 56 on the compression side of piston 108.

A suction valve assembly 114 is also associated with each piston assembly, and will now be described with respect to piston assembly 96 shown in FIG. 1. Suction valve assembly 116 comprises a flat, disk-shaped suction valve 116 which in its closed position covers suction ports 112 on a top surface 118 of piston member 108. Suction valve 116 opens and closes by virtue of its own inertia as piston assembly 96 reciprocates in cylinder 56. More specifically, suction valve 116 rides along a cylindrical guide member 120 and is limited in its travel to an open position by an annular valve retainer 122.

As illustrated in FIG. 1, valve retainer 122, suction valve 116, and guide member 120 are secured to top surface 118 of piston member 108 by a threaded bolt 124 having a button head 128. Threaded bolt 124 is received within a threaded hole 126 in yoke member 106 to secure piston assembly 96 thereto. As shown with respect to the attachment of piston assembly 98 to yoke member 106, an annular recess 130 is provided in each piston member and a complementary boss 132 is provided on the corresponding yoke member, whereby boss 132 is received within recess 130 to promote positive, aligned engagement therebetween.

Compressed gas refrigerant within each cylinder is discharged through discharge ports in a valve plate. With reference to cylinder 58 in FIG. 1, a cylinder head cover 134 is mounted to crankcase 46 with a valve plate 136 interposed therebetween. A valve plate gasket 138 is provided between valve plate 136 and crankcase 46. Valve plate 136 includes a coined recess 140 into which button head 128 of threaded bolt 124 is received when piston assembly 98 is positioned at top dead center (TDC).

A discharge valve assembly 142 is situated on a top surface 144 of valve plate 136. Generally, compressed gas is discharged through valve plate 136 past an open discharge valve 146 that is limited in its travel by a discharge valve retainer 148. Guide pins 150 and 152 extend between valve plate 136 and cylinder head cover 134, and guidingly engage holes in discharge valve 146 and discharge valve retainer 148 at diametrically opposed locations therein. Valve retainer 148 is biased against cylinder head cover 134 to normally retain discharge valve 146 against top surface 144 at the diametrically opposed locations. However, excessively high mass flow rates of discharge gas or hydraulic pressures caused by slugging may cause valve 146 and retainer 148 to be guidedly lifted away from top surface 144 along guide pins 150 and 152.

Referring once again to cylinder head cover 134, a discharge space 154 is defined by the space between top surface 144 of valve plate 136 and the underside of cylinder head cover 134. Cover 134 is mounted about its perimeter to crankcase 46 by a plurality of bolts. Discharge gas within discharge space 154 associated with each respective cylinder passes through a respective connecting passage 156, thereby providing communication between discharge space 154 and a top annular muffling chamber 158. Chamber 158 is defined by an annular channel 160 formed in top surface 66 of crankcase 46, and cage bearing 68. As illustrated, connecting passage 156 passes not only through crankcase 46, but also through holes in valve plate 136 and valve plate gasket 138.

Top muffling chamber 158 communicates with a bottom muffling chamber 162 by means of passageways extending through crankcase 46. Chamber 162 is defined by an annular channel 164 and a muffler cover plate 166. Cover plate 166 is mounted against bottom surface 76 at a plurality of circumferentially spaced locations by bolts 168. Bolts 168 may also take the form of large rivets or the like. A plurality of spacers 170, each associated with a respective bolt 168, space cover plate 166 from bottom surface 76 at the radially inward extreme of cover plate 166 to form an annular exhaust port 172. The radially outward extreme portion of cover plate 166 is biased in engagement with bottom surface 76 to prevent escape of discharge gas from within bottom muffling chamber 162 at this radially outward location.

Compressor assembly 10 of FIG. 1 also includes a lubrication system associated with oil pick-up tube 40 previously described. Oil pick-up tube 40 acts as an oil pump to pump lubricating oil from sump 36 upwardly through an axial oil passageway 174 extending through crankshaft 32. An optional radial oil passageway 176 communicating with passageway 174 may be provided to initially supply oil to sleeve bearing 82. The disclosed lubrication system also includes annular grooves 178 and 180 formed in crankshaft 32 at locations along the crankshaft adjacent opposite ends of suction cavity 60 within sleeve bearings 80 and 84. Oil is delivered into annular grooves 178, 180 behind annular seals 182, 184, respectively retained therein. Seals 182, 184 prevent high pressure gas within discharge pressure space 74 in the housing from entering suction cavity 60 past sleeve bearings 84 and 80, 82, respectively. Also, oil delivered to annular grooves 178, 180 behind seals 182 and 184 lubricate the seals as well as the sleeve bearings.

Another feature of the disclosed lubrication system of compressor assembly 10 in FIG. 1, is the provision of a pair of radially extending oil ducts 186 from axial oil passageway 174 to a corresponding pair of openings 188 on the outer cylindrical surface of eccentric portion 92.

A counterweight 190 is attached to the top of shaft 32 by means of an off-center mounting bolt 192. An extruded hole 194 through counterweight 190 aligns with axial oil passageway 174, which opens on the top of crankshaft 32 to provide an outlet for oil pumped from sump 36. An extruded portion 196 of counterweight 190 extends slightly into passageway 174 which, together with bolt 192, properly aligns counterweight 190 with respect to eccentric portion 92.

Figure 2:
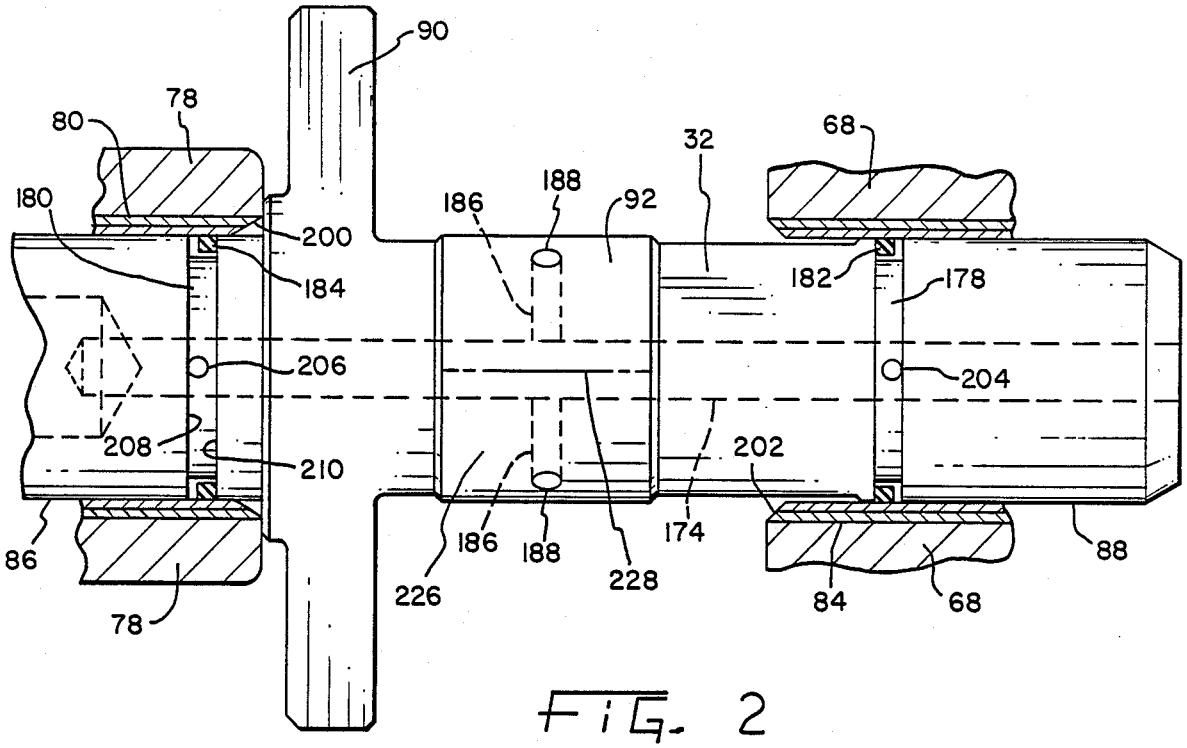
FIG. 2 is an enlarged fragmentary view of the crankshaft of the compressor of FIG. 1, particularly showing crankshaft seals in accordance with the present invention.
Figure 3:
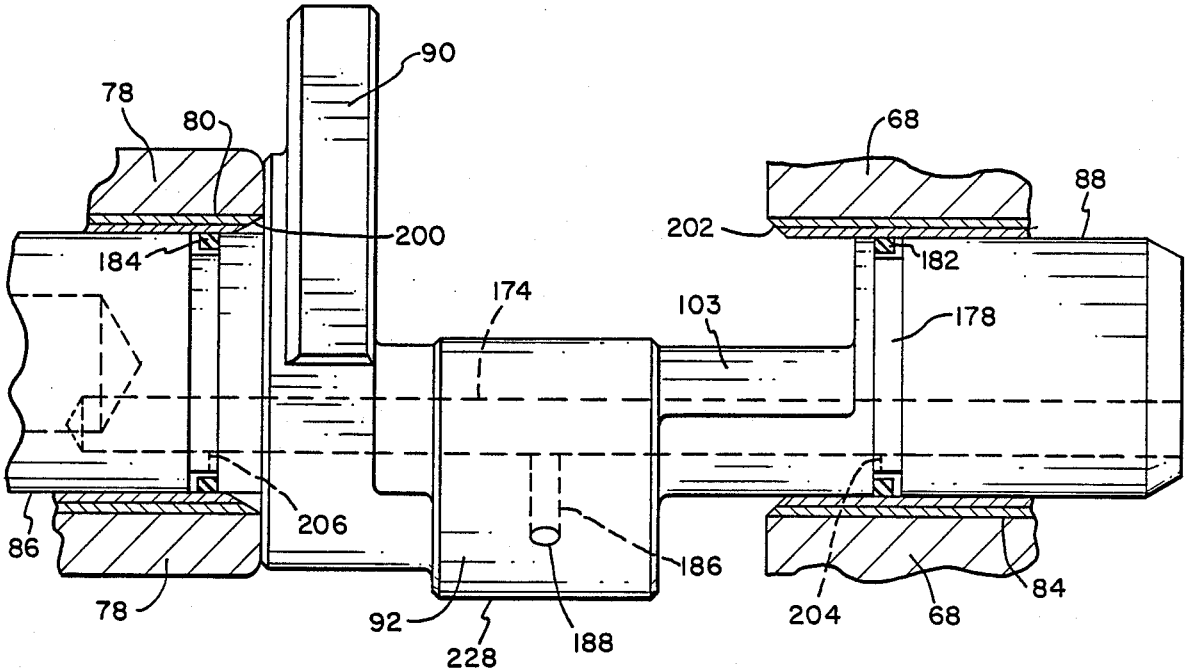
FIG. 3 is a top view of the crankshaft of FIG. 2.

Reference will now be made to FIGS. 2–5 for a more detailed description of the lubrication system and shaft seals according to the present invention. Specifically, FIGS. 2 and 3 show two views of crankshaft 32 journalled in axially aligned sleeve bearings 80 and 84. As previously mentioned, sleeve bearings 80 and 84, shown in FIGS. 2 and 3, are preferably manufactured from a steel-backed bronze material. Sleeve bearings 80, 84 include respective beveled portions 200, 202 at their axially inward ends adjacent suction cavity 60 to facilitate the insertion of the crankshaft into the bearings. Another purpose for beveled portions 200, 202 is to help funnel annular seals 184, 182 into the bearings, where annular seals 184, 182 have an outside diameter greater than the diameter of journal portions 86, 88, respectively.

Lubricating oil from axial oil passageway 174 is introduced into grooves 178, 180 by radial passages 204, 206, respectively. Radial passages 204, 206 are formed by drilling from the groove into axial oil passageway 174. Referring particularly to radial passage 206 shown in FIGS. 2 and 4, the hole is drilled close to the axially outward sidewall 208 to avoid damage to the axially inward sidewall 210, which constitutes a sealing surface for annular seal 184. In the preferred embodiment, passage 206 is spaced approximately 0.030 inches from sidewall 210.

Figure 4:
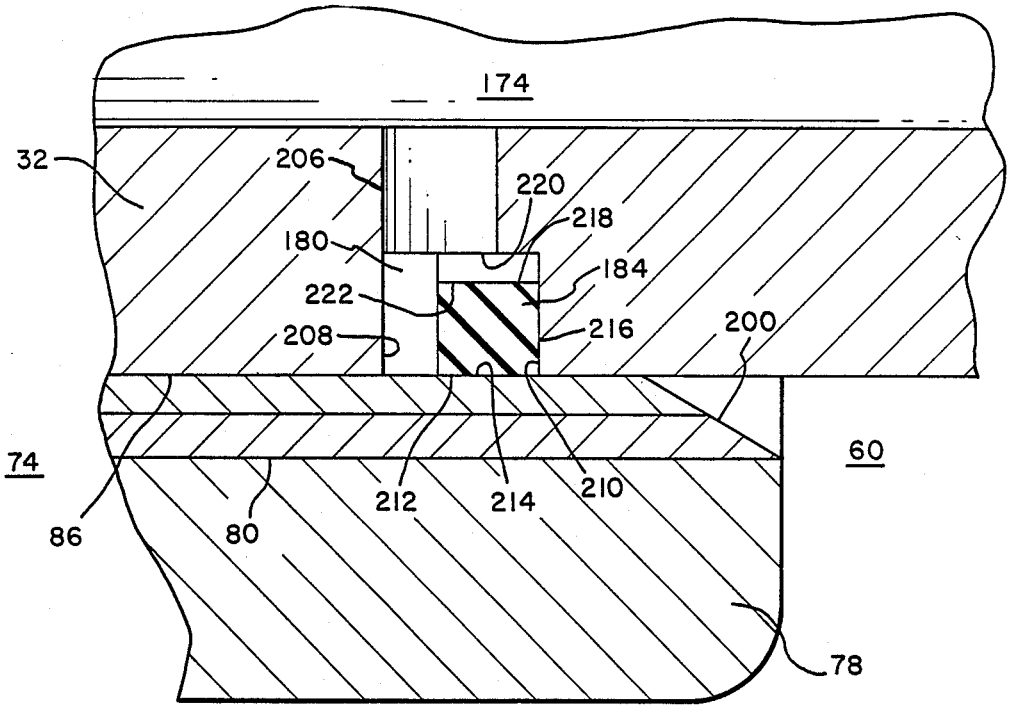
FIG. 4 is an enlarged fragmentary view of a portion of FIG. 3, particularly showing the crankshaft seal arrangement.

Referring more particularly to FIG. 4, annular seal 184 is shown in its operative position during compressor operation. More specifically, the oversizing of the annular seals with respect to the diameter of the journal portion of the crankshaft initially places an outside diameter portion 212 of annular seal 184 in biased sealing contact with an inside cylindrical wall 214 of sleeve bearing 80. Introduction of pressurized oil from axial oil passage 174 through radial passage 206 into annular groove 180 further helps actuate seal 184 radially outwardly against sleeve bearing 80.

A pressure differential exists along sleeve bearing 80 by virtue of one end being exposed to high pressure within discharge pressure space 74 and the other end being exposed to low pressure in suction cavity 60. In the compressor of the preferred embodiment, discharge pressure space 74 is at approximately 297 PSI and suction cavity 60 is at approximately 76 PSI. Consequently, initial gas leakage and subsequent static pressure causes annular seal 184 to seal on an axially inner portion 216 thereof against axially inward sidewall 210 of groove 180. Accordingly, annular seal 184 seals against inside cylindrical wall 214 of bearing 80 and axially inward sidewall 210 of annular groove 180 in crankshaft 32. It will be appreciated that in the preferred embodiment, an inside diameter portion 218 of annular seal 184 is spaced approximately 0.030 inches from bottom wall 220 of groove 180 to provide an annular space 222 in which oil is maintained.

In operation, a very small amount of oil leaks past the sealing contact surfaces between seal 184 and shaft 32, and between seal 184 and bearing 80, to lubricate the seal. However, it has been observed that forced contact of annular seal 184 with axially inward sidewall 210 causes rotation of the seal with the crankshaft. Accordingly, relative movement between parts occurs primarily between seal 184 and bearing 80.

It should be noted that where annular seal 184 is manufactured from carbon filled Teflon, a thin layer of Teflon is initially deposited on the contacting surfaces, such as bearing 80 and sidewall 210, to enhance subsequent sealing and low friction operation of the compressor shaft seals.

An important feature of the shaft seals of the present invention is that oil entering groove 180 is retained not only behind seal 184 in annular space 222. Oil is also channeled 360° radially outwardly adjacent axially outward sidewall 208, so as to provide oil flow between journal portion 86 and inside cylindrical wall 214 to effectively lubricate sleeve bearing 80. It should be appreciated that without annular seal 184 providing sealing between high pressure in discharge pressure space 74 and low pressure in suction cavity 60, oil would not be capable of flowing evenly between journal portion 86 and sleeve bearing 80. Instead, gas leakage would cause the lubricating oil to be blown off of the bearing into the suction cavity, thereby causing dry spots and uneven lubrication resulting in damage to the compressor.

It should be further noted that the annular spacing between journal portion 86 and inside cylindrical wall 214 of sleeve bearing 80 should be kept to a minimum. Excessive clearance, i.e., greater than 0.060 inches, could cause extrusion of annular seal 184 into the space, toward suction cavity 60, due to the aforementioned pressure differential. An annular clearance of 0.010 is recommended for a carbon filled Teflon seal.

It will be appreciated that the annular seals of the present invention are preferably square or rectangular in cross-section. Also, as previously discussed, the outside diameter of the seals is greater than that of the crankshaft. For assembly into the grooves, the seals are resiliently stretched and slid along the length of the crankshaft into position.

Figure 5:
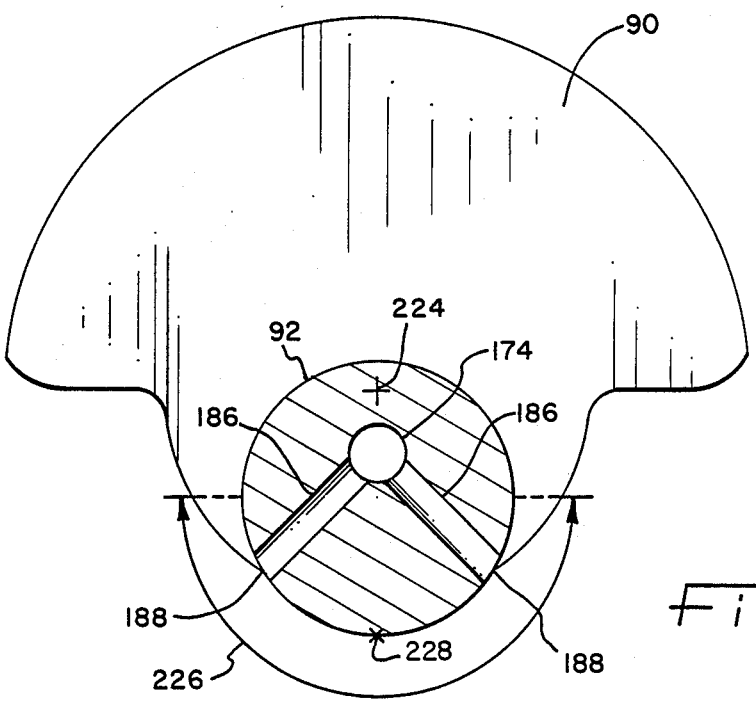
FIG. 5 is a sectional view of the crankshaft of FIG. 3 taken along the line 5—5 in FIG. 3 and viewed in the direction of the arrows.

Referring now to FIG. 5, there is shown a pair of radially extending oil ducts 186 providing lubrication from axial oil passageway 174 to openings 188 on the cylindrical journal surface of eccentric portion 92 for lubricating the scotch yoke mechanism slide block 100. More specifically, openings 188 are located on the radially outermost semicylindrical surface of eccentric portion 92, with respect to an axis of rotation 224 for crankshaft 32, depicted in FIG. 5 by a cross. The aforementioned radially outermost semicylindrical surface is that portion of eccentric 92 visible in FIG. 2, and designated in FIG. 5 as semicircle 226.

It should be appreciated that surface 226 represents that half of eccentric portion 92 considered to be the loaded side, against which slide block 100 bears when gas refrigerant is being compressed by the piston assemblies within the cylinders. Because oil delivered through axial oil passageway 174 is essentially at the discharge pressure existing in discharge pressure space 74, it is necessary and desirable to control the amount of oil delivered through oil ducts 186 and eventually leaking into low pressure suction cavity 60. Accordingly, openings 188 are located on the loaded semicylindrical surface 226, thus causing the openings to be somewhat pinched off by the slide block.

Maximum loading by slide block 100 on eccentric portion 92 is in the area of a line 228 on surface 226 representing maximum eccentricity with respect to axis of rotation 224. So as to not cut off oil delivery to slide block 100 entirely, openings 188 are located circumferentially spaced from line 228. In the preferred embodiment shown in FIG. 5, radially extending oil ducts 186 are symmetric with respect to line 228 and are oriented 90° with respect to one another. It should be understood, however, that other orientations and locations on surface 226 may be provided without departing from the spirit and scope of the present invention.

The provision of a pair of openings 188 is to accommodate for bidirectional operation of compressor assembly 10. More specifically, if maximum loading occurs to one side or the other of the line of maximum eccentricity, one opening will be closed off more while the other is closed off less, thus compensating for one another. Also, it is recognized that by locating holes 188 closer to or further away from the location of maximum loading, one is able to control the flow of lubricating oil without reducing the diameter of ducts 186. Ordinarily, reducing the diameter of the ducts below approximately ⅛ inch, results in difficulty in drilling during manufacturing.

It will be appreciated that the foregoing is presented by way of illustration only, and not by way of any limitation, and that various alternatives and modifications may be made to the illustrated embodiment without departing from the spirit and scope of the invention.

What is claimed is:

1. A compressor assembly, comprising:

a hermetically sealed housing having a discharge pressure space therein;

a crankcase within said housing, said crankcase including a pair of axially aligned sleeve bearings and a plurality of cylinders formed therein, said crankcase including a suction cavity into which said pair of bearings and said plurality of cylinders open, each of said pair of bearings having a first end in communication with said discharge pressure space and a second end in-communication with said suction cavity;

a crankshaft rotatably journalled in said pair of bearings and having an eccentric portion located in said suction cavity;

a plurality of pistons operably coupled to said eccentric portion and operably disposed in respective said cylinders for compressing and discharging refrigerant into said discharge pressure space; and seal means for separating said suction cavity from said discharge pressure space such that during compressor operation pressure leakage from said discharge pressure space into said suction cavity through said pair of bearings is substantially eliminated, said seal means comprising a pair of annular sealing elements each disposed between said crankshaft and a respective one of said pair of bearings.

2. The compressor assembly of claim 1 in which:

said crankshaft includes a pair of journal portions respectively associated with said pair of bearings, each journal portion having an annular groove circumferentially formed therein into which said pair of annular sealing elements are received, respectively.

3. The compressor assembly of claim 2 in which:

said pair of annular grooves are located along a respective said journal portion adjacent said second end of a respective bearing.

4. The compressor assembly of claim 2 in which:

each of said pair of annular sealing elements has an outside diameter portion having a diameter greater than the diameter of said journal portion such that said annular sealing element extends radially outwardly from an associated said groove.

5. The compressor assembly of claim 2, and further comprising:

lubricating means for lubricating said pair of annular seals and said pair of sleeve bearings, said lubricating means comprising means for introducing lubricating oil into said pair of annular grooves.

6. The compressor assembly of claim 5 in which:

each said annular groove includes a bottom wall, an axially outward sidewall toward said first bearing end, and an axially inward sidewall toward said second bearing end, each of said pair of annular sealing elements having an inside diameter portion having a diameter greater than the diameter of said bottom wall, thereby providing a space therebetween into which lubricating oil is received.

7. The compressor assembly of claim 6 in which:

the axial thickness of each of said pair of annular sealing elements is less than the distance between said axially outward sidewall and said axially inward sidewall, whereby oil is permitted to leave said annular groove around said sealing element to lubricate said pair of journalled portions and said pair of sleeve bearings.

8. The compressor assembly of claim 5 in which:

each groove includes a bottom wall, an axially outward sidewall towards said first bearing end, and an axially inward sidewall towards said second wall bearing end, the axial thickness of each of said pair of annular sealing elements being less than the distance between said axially outward sidewall and said axially inward sidewall, whereby oil is permitted to leave said annular groove around said sealing element to lubricate said pair of journalled portions and said pair of sleeve bearings.

9. The compressor assembly of claim 1 in which:

said pair of sleeve bearings include beveled ends to permit funneling of said annular sealing elements into position between said crankshaft and a respective one of said pair of bearings.

10. The compressor assembly of claim 1 in which:

said pair of annular sealing elements are composed of a material including Teflon.

11. The compressor assembly of claim 1 in which:

said plurality of cylinders are radially disposed in said crankcase and are in communication with said suction cavity.

12. A compressor assembly, comprising:

a hermetically sealed housing including a discharge pressure space within;

a crankcase within said housing, said crankcase including a pair of axially aligned sleeve bearings and a plurality of cylinders formed therein, said crankcase including a suction cavity into which said pair of bearings and said plurality of cylinders open, each of said pair of bearings having a first end in communication with said discharge pressure space and a second end in communication with said suction cavity;

a crankshaft having a pair of journals and an eccentric portion, each one of said pair of journals being rotatably supported in a respective one of said pair of bearings and said eccentric portion being located in said suction cavity;

a plurality of pistons operably coupled to said eccentric portion and operably disposed in respective said cylinders for compressing and discharging refrigerant into said discharge pressure space;

means for supplying lubricating oil from a sump in said housing to said pair of bearings; and seal means for substantially preventing lubricating oil from entering said suction cavity, said seal means including a pair of annular sealing elements, each of said pair of sealing elements being disposed between said crankshaft and a respective one of said pair of bearings at a location adjacent said second end thereof.

13. The compressor assembly of claim 12 in which:

each of said pair of journals has an annular groove circumferentially formed therein into which said pair of annular sealing elements are respectively received, each groove including a bottom wall, an axially outward sidewall toward said first bearing end, and an axially inward sidewall toward said second bearing end, said means for supplying lubricating oil comprising an axial oil passageway in said crankshaft and a radial oil passage communicating between said axial oil passageway and an opening in said bottom wall spaced from said axially inward sidewall.

14. The compressor assembly of claim 13 in which:

each of said pair of annular sealing elements has an inside diameter portion having a diameter greater than the diameter of said bottom wall, thereby providing a space therebetween into which lubricating oil is received.

15. The compressor assembly of claim 14 in which:

the axial thickness of each of said pair of annular sealing elements is less than the distance between said axially outward sidewall and said axially inward sidewall, whereby oil is permitted to leave said annular groove around said sealing element to lubricate said pair of journals and said pair of sleeve bearings.

16. The compressor assembly of claim 13 in which:

the axial thickness of each of said pair of annular sealing elements is less than the distance between said axially outward sidewall and said axially inward sidewall, whereby oil is permitted to leave said annular groove around said sealing element to lubricate said pair of journals and said pair of sleeve bearings.

17. The compressor assembly of claim 12 in which:

said plurality of cylinders are radially disposed in said crankcase and are in communication with said suction cavity.

18. A compressor assembly, comprising:

a hermetically sealed housing defining a discharge pressure space;

a crankcase within said housing, including a pair of axially aligned sleeve bearings and a plurality of cylinders formed therein, said crankcase defining a suction cavity into which said pair of bearings and said plurality of cylinders open, each of said pair of bearings having a first end in communication with said discharge pressure space and a second end in communication with said suction cavity;

a crankshaft having a pair of journals and an eccentric portion, each of said pair of journals being rotatably supported in a respective one of said pair of bearings, and said eccentric portion being located in said suction cavity, said crankshaft further having a pair of annular grooves formed one in each of said pair of journals;

a plurality of pistons operably coupled to said eccentric portion and disposed in respective said cylinders for compressing and discharging refrigerant into said discharge pressure space;

a pair of ring-like sealing elements, each having an inside diameter portion positioned in a respective one of said pair of annular grooves and an outside diameter portion contacting a corresponding one of said pair of bearings;

means for supplying lubricating oil from a sump in said housing to said pair of annular grooves such that oil lubricates said pair of sealing elements and said pair of bearings, said oil supplying means including an axial oil passageway extending through said crankshaft.

19. The compressor assembly of claim 18 in which:

said means for supplying lubricating oil includes a pair of radial oil passages, each of said passages communicating between said axial oil passageway and a respective said annular groove.

20. The compressor assembly of claim 18 in which:

said plurality of cylinders are radially disposed in said crankcase and are in communication with said suction cavity.

21. A compressor assembly, comprising:

a hermetically sealed housing having a housing chamber therein at discharge pressure;

an oil sump within said housing chamber;

a crankcase within said housing, including a yoke cavity therein at suction pressure and a plurality of cylinders;

a crankshaft rotatably journalled in said crankcase having a central axis of rotation and including a cylindrical eccentric portion with respect to said central axis;

seal means on said crankshaft for sealing said yoke cavity from said housing chamber;

a plurality of pistons operably received within respective said cylinders;

coupling means within said yoke cavity for operably coupling said plurality of pistons to said eccentric portion, said coupling means including a sleeve bearing in which said eccentric portion is journalled; and, means for lubricating said sleeve bearing comprising a centrifugal oil pump drivingly connected to said crankshaft and in fluid communication with said oil sump, an axial oil passageway in said crankshaft through which oil from said oil sump is pumped, and an oil delivery hole in said eccentric portion located on the radially outermost semicylindrical surface of said eccentric portion with respect to said central axis, said oil delivery hole being in fluid communication with said axial oil passageway.

22. The compressor assembly of claim 21 in which:

said oil delivery hole is located on said semicylindrical surface at a location away from a line on said semicylindrical surface representing the location of maximum eccentricity with respect to said central axis of rotation.

23. The compressor assembly of claim 21 in which:

said means for lubricating said sleeve bearing includes a pair of oil delivery holes in said eccentric portion located at symmetric locations with respect to a line on said semicylindrical surface representing the location of maximum eccentricity with respect to said central axis of rotation.

24. The compressor assembly of claim 23 in which:

said pair of oil delivery holes is circumferentially spaced on said semicylindrical surface 90° apart from one another.

25. The compressor assembly of claim 21 in which:

said plurality of cylinders are radially disposed in said crankcase.

26. A scotch yoke compressor assembly comprising: a housing including a housing chamber at discharge pressure, a crankcase within said housing, a suction cavity at suction pressure included within said crankcase, a plurality of cylinders in said crankcase extending radially outwardly from said suction cavity, a plurality of pistons operably received within respective said cylinders, a crankshaft rotatably journalled in said crankcase and having an axis of rotation and an eccentric portion located within said suction cavity, seal means on said crankshaft for sealing said suction cavity from said housing chamber, means within said suction cavity for operably coupling said plurality of pistons to said eccentric portion including a bearing surface against which said eccentric portion rides to cause reciprocation of said plurality of pistons in respective said cylinders, centrifugal oil pumping means for providing lubricating oil from a sump in said housing chamber to an axial oil passageway in said crankshaft extending to said eccentric portion thereof and means for lubricating said bearing surface such that lubricating oil introduced into said suction cavity is substantially reduced to improve the operating efficiency of said compressor, said lubricating means comprising a pair of radial oil ducts providing communication between said oil passageway and a pair of openings on the surface of said eccentric portion at respective locations on the radially outermost semicylindrical surface of said eccentric portion with respect to said axis of rotation, said pair of openings being substantially symmetric with respect to a line on said outermost semicylindrical surface parallel to said axis of rotation and representing maximum eccentricity.

27. The scotch yoke compressor assembly of claim 26 in which:

said compressor is bidirectionally operable.

28. The scotch yoke compressor assembly of claim 26 in which:

said pair of openings is circumferentially spaced on said semicylindrical surface 90° apart from one another.

29. A compressor assembly, comprising:

a hermetically sealed housing including a discharge pressure space;

a crankcase within said housing, including a pair of axially aligned sleeve bearings and a plurality of radially disposed cylinders formed therein, said crankcase including a suction cavity into which said pair of bearings and said plurality of cylinders open, each of said pair of bearings having a first end in communication with said discharge pressure space and a second end in communication with said suction cavity;

a crankshaft rotatably journalled in said crankcase having a central axis of rotation and including a cylindrical eccentric portion with respect to said central axis;

seal means for separating said suction cavity from said discharge pressure space such that during compressor operation pressure leakage from said discharge pressure space into said suction cavity through said pair of bearings is substantially eliminated, said seal means comprising a pair of annular sealing elements each disposed between said crankshaft and a respective one of said pair of bearings;

a plurality of pistons operably received within respective said cylinders for compressing and discharging gas refrigerant into said discharge pressure space;

coupling means for operably coupling said plurality of pistons to said eccentric portion, said coupling means including a coupling bearing in which said eccentric portion is journalled; and, means for lubricating said coupling bearing surface such that the amount of lubricating oil introduced into said suction cavity is substantially reduced to improve the operating efficiency of said compressor, said lubricating means including an oil delivery hole in said eccentric portion located on the radially outermost semicylindrical surface of said eccentric portion with respect to said central axis.

* * * * *